US005722100A

United States Patent [19]

Jozwiak

[11] Patent Number: 5,722,100

[45] Date of Patent: Mar. 3, 1998

[54] BABY BATHING APPARATUS

[76] Inventor: Gail R. Jozwiak, 4130 N. Spider Lake Rd., Traverse City, Mich. 49684

[21] Appl. No.: 561,071

[22] Filed: Nov. 20, 1995

Related U.S. Application Data

[63] Continuation-in-part of Ser. No. 326,382, Oct. 20, 1994, abandoned.

[51] Int. Cl.[6] ..... A47K 3/024

[52] U.S. Cl. ..... 4/572.1; 5/655

[58] Field of Search ..... 4/546, 548, 551, 4/572.1, 586, 587, 579, 659; 5/110, 112, 310, 655

[56] References Cited

U.S. PATENT DOCUMENTS

| | | | |
|---|---|---|---|
| 2,507,848 | 5/1950 | Bashaw | 4/572.1 |
| 3,799,228 | 3/1974 | Crawford | 4/572.1 X |
| 4,713,850 | 12/1987 | Flaherty et al. | 4/587 X |
| 5,406,655 | 4/1995 | Sahlin | 4/572.1 |

FOREIGN PATENT DOCUMENTS

| | | | |
|---|---|---|---|
| 0370172 | 4/1932 | United Kingdom | 4/572.1 |

*Primary Examiner*—Charles E. Phillips
*Attorney, Agent, or Firm*—Merlin B. Davey

[57] ABSTRACT

This invention provides a baby bathing apparatus adapted for use in divided sinks, single sinks and tubs comprising a generally rectangular reinforced open frame having four sides, a top surface and a bottom surface, an open, net-like non-absorbent fabric disposed within and attached to each side of said frame, said frame having four corners and having a removable leg attached approximate each of said corners on the bottom surface of said frame, said attachment being by means of self-locking snaps.

4 Claims, 1 Drawing Sheet

BABY BATHING APPARATUS

CROSS-REFERENCE TO RELATED APPLICATIONS

This application is a continuation-in-part of application Ser. No. 08/326,382 filed Oct. 20, 1994 now abandoned.

BACKGROUND OF THE INVENTION

1. Field of the Invention

This invention relates to baby bathing apparatus that may be used on a table, counter, in a sink or bath tub.

2. State of the Prior Art

There are many different types of devices that have been employed for bathing infants, such as, for example, those disclosed in U.S. Pat. Nos. 4,216,552; 4,602,394; 4,602,392; 4,561,135; 1,758,071; 1,792,696; 2,495,482; 2,507,848; 2,659,090 and 3,799,228. While providing means for bathing babies, none of the devices available in the art provide a light weight apparatus that can be readily employed on a convenient surface such as a table top or counter or in a single sink, double sink or bath tub while using a damp cloth or a minimal amount of water, as is now generally recommended, without exposing the baby to slippery or hard surfaces and which drys quickly and is easily stored.

SUMMARY OF THE INVENTION

This invention provides a baby bathing apparatus adapted for use on a convenient surface such as a counter top or table top or in divided sinks, single sinks or tubs comprising a generally rectangular reinforced open frame having four sides, a top surface and a bottom surface, an open, net-like non-absorbent quick drying flow-through fabric disposed within and attached to each side of said frame, said frame having four corners and a removable leg attached approximate each of said corners on the bottom surface of said frame, said attachment preferably being by means of self-locking snaps.

BRIEF DESCRIPTION OF THE DRAWINGS

Referring to the drawings.

DETAILED DESCRIPTION

Figure 1:
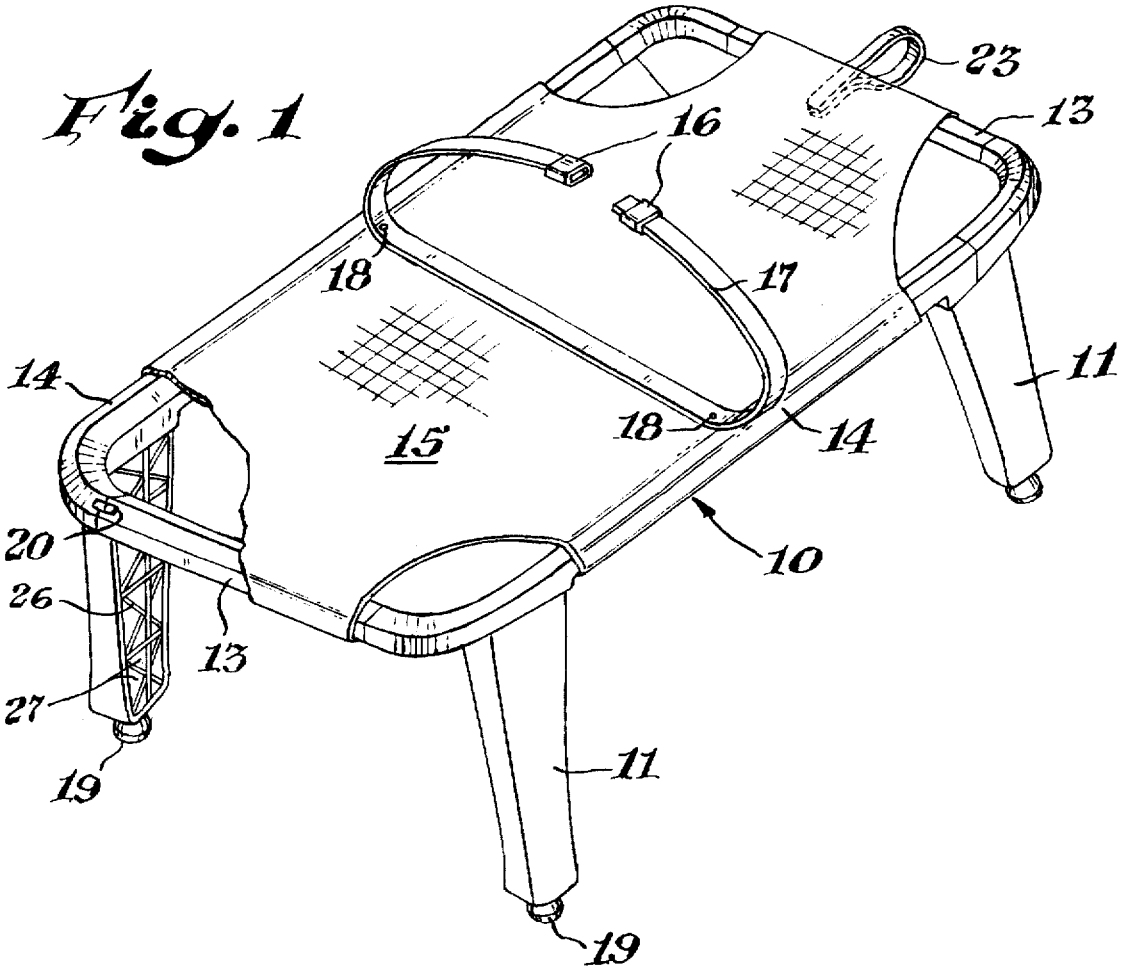
FIG. 1 is an isometric of one embodiment of the present invention.

Referring to FIG. 1, a baby bathing apparatus in accordance with one embodiment of this invention is indicated by 10. As shown in FIG. 1, the frame comprises opposed end portions 13 and opposed side portions 14 and is supported by legs 11 which may include non-skid tips 19. For more secure support legs 11 may be angled outward slightly from the vertical such as by an angle of about 5 degrees and of various lengths such as when one wishes to have the apparatus hold a baby on a slight incline. As indicated in FIG. 1, frame end portion 13 may be removably attached to frame side portion 14 advantageously by means of self-locking snap connectors, one shown at junction point 20. Apparatus 10 includes an open net-like non-absorbent quick drying fabric 15 disposed within and attached to frame end and side portions 13 and 14, said fabric permitting the rapid passage of water therethrough. Safety strap 17 is attached to fabric 15 at attachment points 18. Buckle 16 is employed to secure a baby when it is being bathed.

Figure 2:
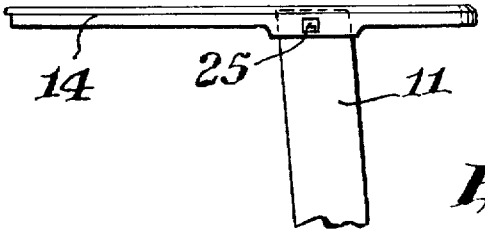
FIG. 2 is a cut-away illustrating a means of attaching removable legs to the apparatus of the present invention.

FIG. 2 illustrates a removable leg where self-locking snap 25 is attached to leg 11 and is adapted to engage an appropriate slot in frame member 14.

Figure 3:
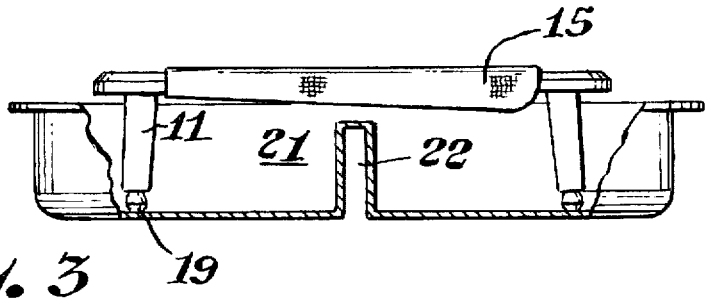
FIG. 3 is an illustration of the use of the baby bathing apparatus of this invention in a divided sink.

FIG. 3 illustrates the use of a baby bathing apparatus of this invention in a divided sink 21 having a divider 22. As shown in FIG. 3, legs 11, plus leg tips 19 serve to hold fabric 15 above sink divider 22, thereby avoiding baby contact with the divider.

The frame and legs of the baby bathing apparatus of this invention can be made of any material capable of supporting up to about 40 pounds when completely assembled and may be of any desired structural form, such as, for example, rectangular, triangular or tubular. Such materials include aluminum, wood, plastics, stainless steel alloys and ceramics and any materials having the necessary strength and resistance to aqueous environments and do not pose a hazard to a baby. The frame and legs are advantageously made of polypropylene or polyethylene, preferably an open, cross-ribbed reinforced material as illustrated in FIG. 1 wherein 26 indicates cross-ribbing reinforcement and 27 indicates open spaces which allows ready drainage and drying thereby reducing or eliminating the growth of bacteria and fungi. The frame is advantageously from 14 to 20 inches in width and 20 to 30 inches in length, desirably about 15 by about 26 inches in width and length respectively. The legs are from about 6 to about 12 inches long, desirably about 9 inches long. The assembled apparatus is easily hung for drying.

Fabric 15 is made of any open, net-like non-absorbent material that is environmentally safe and of sufficient strength to hold an infant up to about 40 pounds weight. The fabric is advantageously made of a synthetic acrylic fiber and allows water to readily flow through. Because fabric 15 is non-absorbent and water flows readily therethrough there is no need to remove to wash. Simply hang the apparatus up to dry as with, for example, a cloth hook or loop 23 which may be attached to fabric 15.

Because the frame may be assembled and disassembled by means of self-locking snaps and the legs are removable by release of self-locking snap 25, the entire baby bathing apparatus can be readily stored in a minimum amount of space for ease of storing and/or transport.

Various modifications may be made in the present invention without departing from the spirit or scope thereof as will be readily apparent to those skilled in the art.

I claim:

1. A baby bathing apparatus adapted for use in divided sinks, single sinks and tubs, comprising a generally rectangular frame having four sides, a top surface and a bottom surface, and open, net-like non-absorbent quick drying fabric disposed within and attached to each side of said frame for allowing water to pass readily therethrough, said frame having four corners and having a removable leg attached approximate each of said corners on the bottom surface of said frame by cooperation of a self-locking snap attached to each leg, and a slot at each corner of said frame, each leg being 6 to 12 inches long such that said apparatus may be located in a divided sink with said frame straddling the sink divider, each leg being constructed of an open cross-ribbed construction, the respective sides of said frame being interconnected by self-locking snaps and slots such that said apparatus can be rendered compact for storage.

2. Apparatus of claim 1 including a safety strap attached to said fabric.

3. Apparatus of claim 1 wherein the frame and legs are comprised of polypropylene.

4. Apparatus of claim 1 where the fabric is a polyacrylic fabric.

* * * * *